United States Patent [19]

Wakelin

[11] 4,384,830

[45] May 24, 1983

[54] METHODS OF AND/OR APPARATUS FOR DISPLACING FLUIDS

[76] Inventor: Russell R. F. Wakelin, 66 Paine St., Tauranga, New Zealand

[21] Appl. No.: 132,531

[22] Filed: Mar. 21, 1980

[30] Foreign Application Priority Data

Mar. 22, 1979 [NZ] New Zealand ..... 189971

[51] Int. Cl.[3] ..... F04B 19/20

[52] U.S. Cl. ..... 417/436

[58] Field of Search ..... 417/436

[56] References Cited

U.S. PATENT DOCUMENTS 718,621 1/1903 Guenther ..... 417/436

3,464,380 9/1969 Thorden ..... 417/436

3,551,078 12/1970 Affeld ..... 417/436

*Primary Examiner*—Richard E. Gluck

*Assistant Examiner*—Peter M. Cuomo

*Attorney, Agent, or Firm*—Holman & Stern

[57] ABSTRACT

A method of and apparatus for displacing fluids in which a housing is provided which has an end wall and an opening opposite the end wall. A blade is positioned in the housing and rectilinear motion is imparted to the blade so that one end of the blade is moved while the other end dwells so that fluid is drawn in to one side of the blade and expelled by the reducing volume on the other side of the blade.

21 Claims, 15 Drawing Figures

METHODS OF AND/OR APPARATUS FOR DISPLACING FLUIDS

BACKGROUND OF THE INVENTION

Description of the Prior Art

Pumps, that is to say apparatus for displacing fluids, which are at present available have some disadvantages. In particular, the apparatus can become blocked, particularly when solid material is to be pumped, and some blockages can require dismantling of the apparatus to enable the blockage to be cleared. Also, particularly when solids are being pumped, crushing of the solids can occur which is undesirable.

Also it is desirable that the pumping rate of the apparatus for displacing fluids be variable and it is desirable that the same torque be delivered per stroke regardless of the pumping rate.

SUMMARY OF THE INVENTION

It is, therefore, an object of the present invention to provide methods of and apparatus for displacing fluids which will obviate or minimize the foregoing disadvantages and go at least some distance towards the foregoing desiderata in a simple yet effective manner or which will at least provide the public with a useful choice.

Accordingly, one aspect the invention consists in a method of displacing fluids, the method comprising the steps of imparting rectilinear motion to a blade positioned in a housing which housing includes or mounts an end wall and has an opening or openings opposite said end wall, said movement being by means of at least two moving means disposed at each end of said blade, said rectilinear motion being such that the end of said blade adjacent said opening is moved from a position adjacent to one side or wall of the housing to a position adjacent the opposite side or opposite wall of said housing while the other end of the blade dwells, the other end of said blade then moving across the end wall from a position closer to said one wall to a position closer to said other wall while said first end dwells, each movement of said blade being such that fluid is displaced from said housing in a desired direction.

In a further aspect the invention consists in apparatus for displacing fluids said apparatus comprising a housing having or mounting an end wall and an opening or openings opposite the end wall, a blade movable in said housing so that the end of the blade adjacent the opening moves from a position adjacent one wall of said housing to a position adjacent the other wall of said housing while the other end of the blade dwells, the other end of said blade then moving across the end wall from a position closer to said one wall to a position closer to the opposite wall while said first end dwells, and at least two moving means positioned at least one towards each end of the blade, the construction and arrangement being such that said blade is actuated by said moving means to displace fluids from said housing in a desired direction.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings in which.

DESCRIPTION OF THE PREFERRED EMBODIMENTS

The term fluids as used herein means liquids and gases and fluids containing solids and/or semi-solids.

Figure 1:
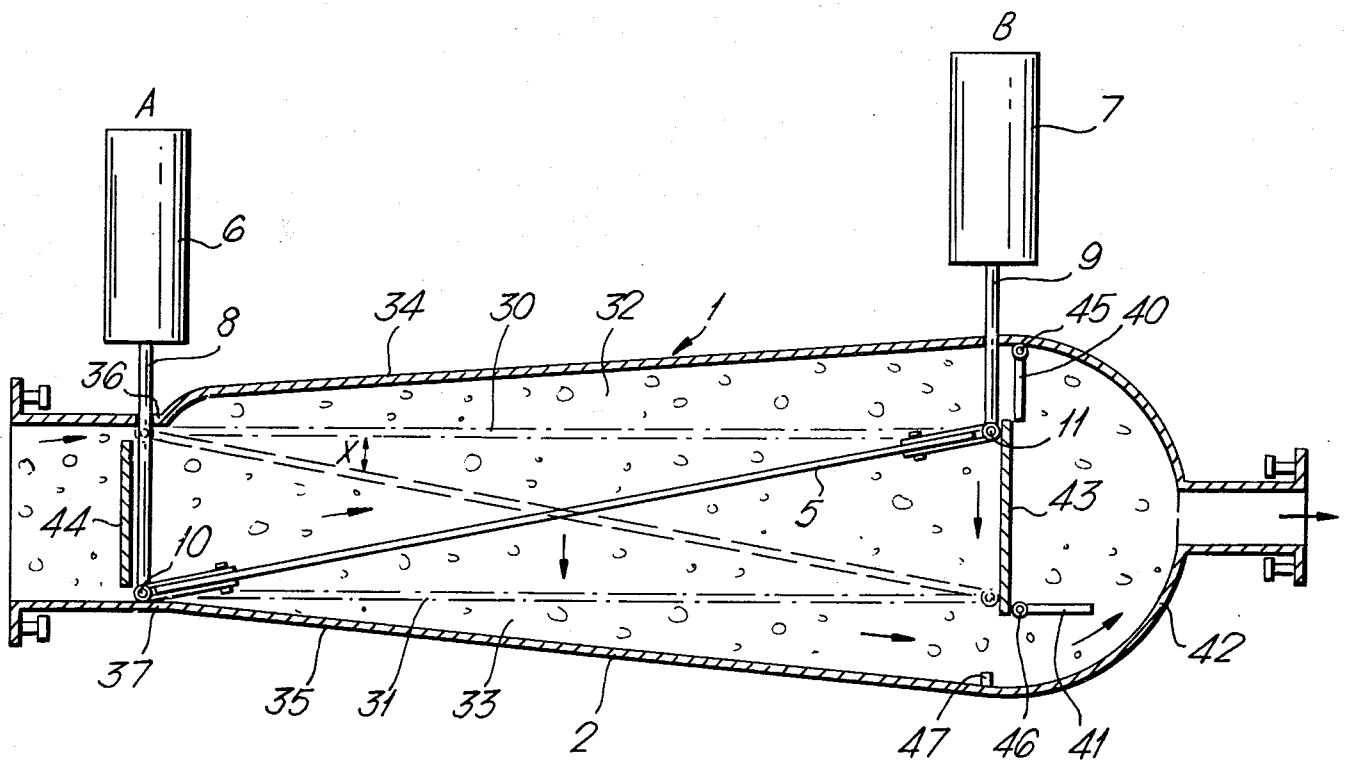
FIG. 1 is a cross sectional side view of apparatus according to one form of the invention.
Figure 11:
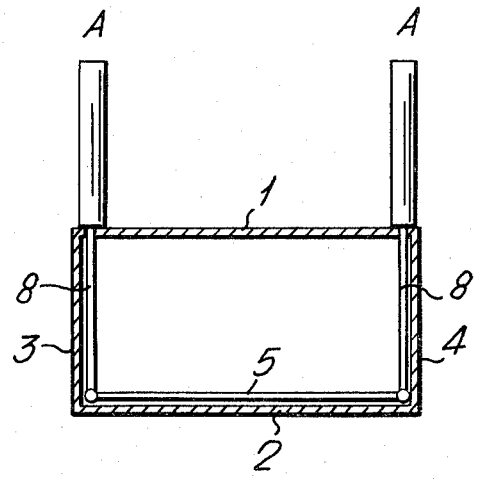
FIG. 11 is a cross section of apparatus as in FIGS. 3 to 10.
Figure 14:
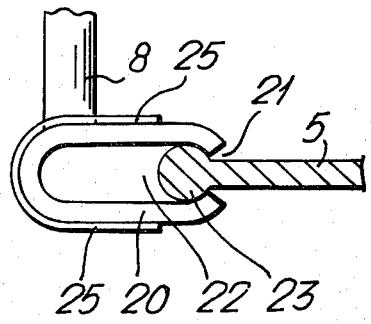
FIG. 14 shows an alternative means of connecting the blade.
Figure 12:
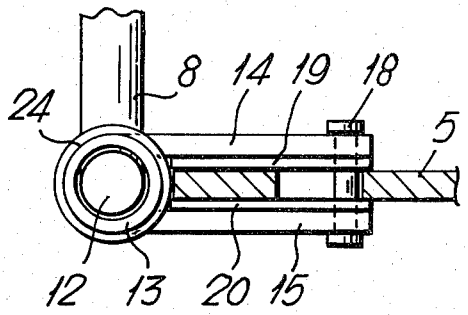
FIG. 12 shows a side elevation of one method of joining a blade to a preferred form of moving means.
Figure 13:
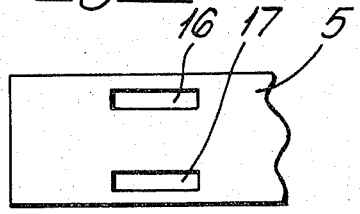
FIG. 13 is a plan view of a blade or part of a blade as used in FIG. 12.

Referring to the drawings a housing is provided which may be rectangular or otherwise, thus referring to FIG. 11 the tube may have upper side or wall 1 lower side or wall 2 and sides joined between the upper and lower walls 1 and 2 being walls 3 and 4. Referring to FIG. 1, walls 1 and 2 are bulbous and the sides 3 and 4 are substantially parallel. Moving within the housing is a plate or blade 5 which is a movable fit within the housing, and is movable as shown in the drawings. The plate 5 is moved by at least two moving means, and in the embodiment shown in the drawings a moving means A is positioned near one end of the blade 5 and the moving means B is positioned near the opposite end of the plate. As shown in the drawings such moving means each comprise piston and cylinder assemblies 6 and 7 each having respectively pistons 8 and 9. The pistons 8 and 9 are pivotally and slidably attached to the plate 5 at 10 and 11 and FIGS. 12, 13 and 14 show two possible methods by which this may be achieved. FIG. 11 shows two moving means at each end of the housing, this arrangement provides minimum disturbance to fluid flow. The pistons or the lifting rods can be positioned inside the housing or alternatively could run in channels within the housing walls.

Referring to FIG. 12 the piston 8 terminates in an axle 12 which mounts a ring or loop member 13 having a pair of substantially parallel but spaced apart arms 14 and 15. The plate 5 is positioned between the arms 14 and 15 and includes apertures 16 and 17 through which pin 18 passes. Bearers or slipping pads 19 and 20 may be provided between the upper and lower surfaces of the blade 5 and the arms 14 and 15 respectively.

FIG. 14 shows an alternative arrangement wherein the piston 8 terminates in a channel member 20, the mouth 21 of which is somewhat narrower than the internal part 22. The blade 5 terminates in an enlargement such as a bulbous rib 23 which moves within the space 22 so that the blade 5 extends through the mouth 21. A sealing or friction pad can be provided between enlargement 23 and channel member 20.

Thus the blade may slide or the enlargement of the blade may slide in the part 22 of the channel 20 allowing also a pivotal movement as required. To enable sealing of the blade to the upper and lower walls of the tube in use, seals may be provided either on the upper and lower walls 1 and 2 or more preferably on the parts 13 or 20 or both if required. The seals may take the form of rubber seals such as a ring of rubber ring material 24 or a rubber pad 25 affixed to the members 13 and 20 respectively.

The sliding arrangement is required to compensate for increasing lengths between the lower end of the pistons 8 and 9 during use but alternative methods of overcoming this change in length may be used, for example, the piston and cylinder assembles 6 and 7 may be pivotally mounted in the top of the tube or alternatively the blade 5 may be made flexible or semi-flexible and of substantially of the longest required length. Thus when the length shortens for example as pistons 8 and 9 are both in the retracted position or both in an extended position, the blade will to some extent become loose. This looseness may be taken up by providing the upper and lower walls 1 and 2 in a convex shape when considered from the inner part of the tube so that the flexible blade will be laid over the convex surface to take up the slack. Thus assuming the moving means are 760 mm apart and the distance apart between the walls is say 200 mm when the one moving means is fully extended then the other fully retracted, the distance between the point of connection of the moving means to the blades will be about 790 mm. Accordingly the curved surface of the walls will be adjusted in length so that the curved surface is 790 mm between the points of entry through such curved surface of the moving means.

In a further embodiment, this difficulty can be overcome by providing a blade which is elastic so that as the length between the lower ends of the pistons 8 and 9 varies the blade 5 will be stretched elastically or allowed to contract elastically to take account of these varying lengths.

In any event, the blade 5 may have stiffening ribs (not shown).

Although the plate can be moved so that it is against the lower wall 1 and against the upper wall 2 in use, it is desirable particularly where solids, such as coal, are to be pumped, that the extent of the movement of the blade is not from wall 1 to wall 2 at least over the major part of the stroke.

Thus, referring to FIG. 1, pecked position 30 shows a desirable upper limit and pecked position 31 shows a desirable lower limit so that space 32 and space 33 are left between the position 30 and the upper wall 1 and the position 31 and the lower wall 2. The spaces 32 and 33 may be achieved by providing an enlarged bore to the housing over the areas 34 and 35 so that at positions 36 and 37 the sealing members such as 24 and 25 may seal against the tube at those positions on the upper and lower sides thereof, but, so that at the ends of the blade attached to piston 9, movement particularly in FIG. 1, does not extend fully to the upper wall 1 or the lower wall 2.

FIGS. 3 to 6 and 7 to 10 also show other arrangements whereby the enlarged bore may be achieved.

Referring to FIG. 1, it is also desirable to increase the efficiency by means of valving and to this end valves 40 and 41 may be provided at end 42 (FIG. 1) of the tube. The valve may be pivotally affixed to a dividing member or end wall 43 mounted within the tube between the side walls 3 and 4.

A similar dividing member or end wall 44 may be provided at the inlet end.

The flap valve 40 is preferably pivotally attached to the upper wall 1 by pivot 45 and the flap valve 41 is preferably pivotally attached to the end wall 43 for example by pivot 46.

Thus, in use, a stream of fluid moving from left to right in FIG. 1 will be divided to pass between valves 40 and 41. A stop 47 may be provided against which valve 41 may rest and the valve 40 may be prevented from moving too far in a clockwise position by engagement against the stop member 43.

It is desirable that stop such as 47 may be withdrawn so that if desired the valve flap 41 may operate to open in the other direction a further stop being extended as required, or the same stop may be used. A similar arrangement may be provided to enable the valve flap 40 to operate in the reverse direction.

Figure 2:
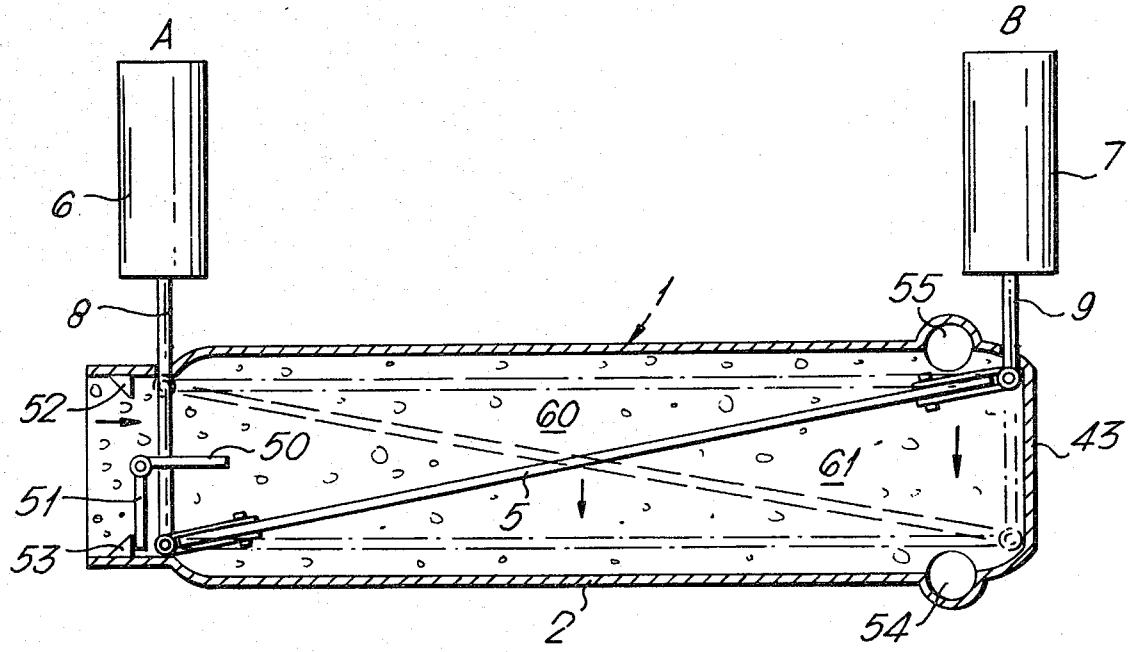
FIG. 2 is a view as in FIG. 1 of an alternative form of the invention.

Referring to FIG. 2, flaps 50 and 51 are provided at the inlet end to the tube. Abuttments 52 and 53 are provided on the upper and lower walls 1 and 2 and one or other of the flaps will be opened during operation or each flap may be opened to some extent as will be described later.

Reversible valves in the form of rotatable ball sockets containing flaps may be used for the valves in FIG. 1 and FIG. 2 if desired.

At the other end of the tube outlet extensions 55 and 54 are provided.

Figure 3:
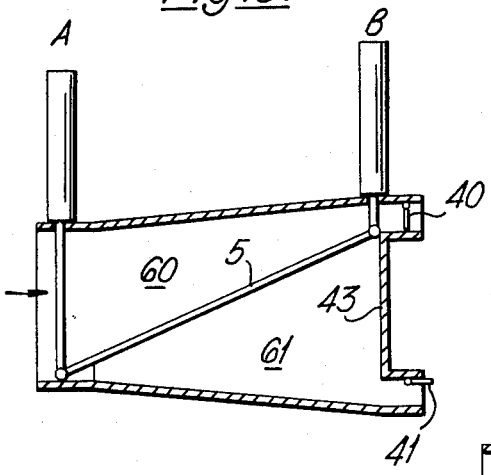
FIGS. 3 to 6 are cross sectional side elevations of apparatus according to the invention showing various dispositions of the blade for material movement in a first direction.
Figure 4:
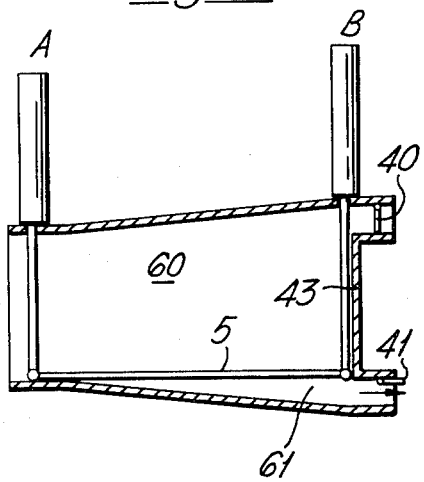

The use of the invention is as follows:

Referring initially to FIGS. 3 to 6 and with the blade initially in the position shown in FIG. 3, movement of the blade 5 to the position shown in FIG. 4 will cause material, i.e. fluid, solids or semi-solids, or mixtures thereof, to be drawn into the space 60 above the blade 5 and to be expelled from the space 61 below the blade causing flap 41 to open. Flap 40 will be closed because of the tendency to draw material into the space 60.

Figure 5:
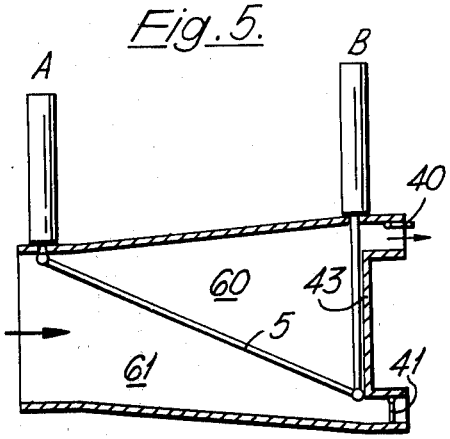
Figure 6:
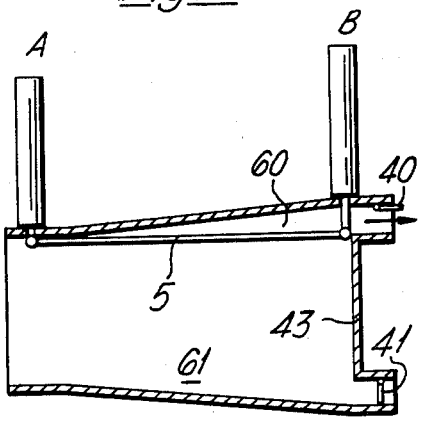

If blade 5 is then moved to the position shown in FIG. 5, flap 41 will close and flap 40 will open as fluid is drawn into the space 61 and expelled from space 60. Further movement to the position shown in FIG. 6 will cause further expulsion of fluid past flap 40 and further indrawing of material into space 61.

The next movement will return the blade to the position shown in FIG. 3 where fluid will be drawn into the space 60 and expelled from the space 61.

Figure 15:
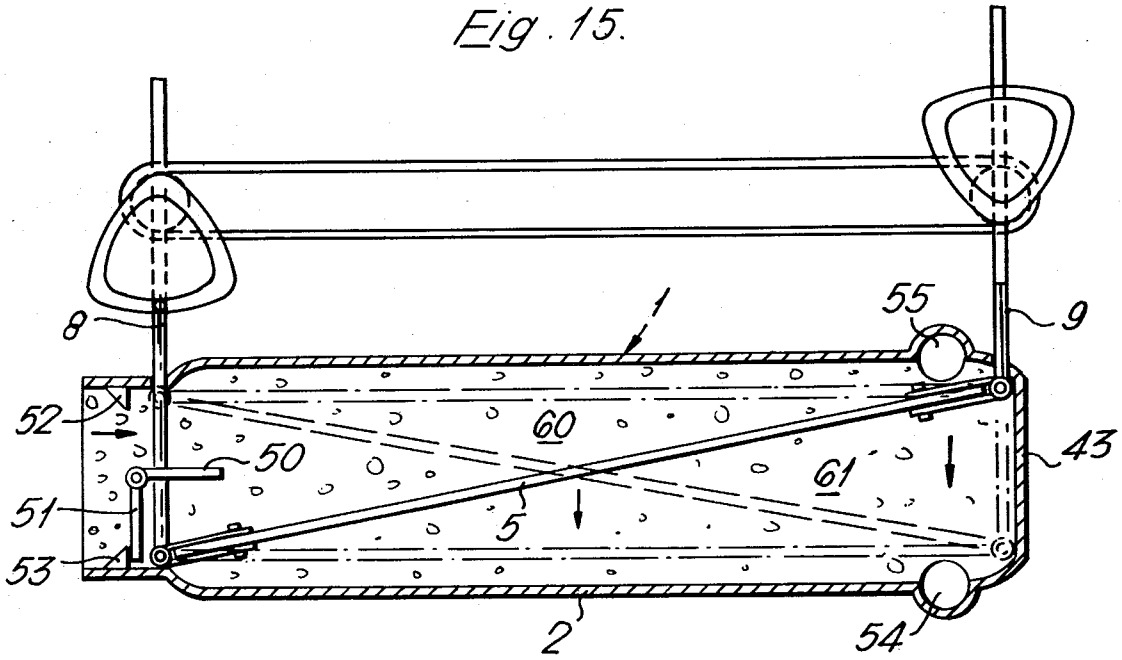
FIG. 15 illustrates a mechanically actuated reciprocating mechanism for timing the movement and dwell time of the blade.

Timing means are provided so that each end of blade 5 dwells at the end of its movement for the time required by the other end of the blade 5 to move the whole length of its stroke. Movement of the piston and cylinder assemblies 6 and 7 may be initiated by mechanical contact between the other piston or other end of the blade 5 and a suitable switch, such as micro-switches which in turn activate solenoid valves. Mechanically the required dwell can be introduced as shown in FIG. 15 by cams 70 having part of the periphery in the form of an arc or part circle 71, which cams in use bear on the operating rods.

Figure 7:
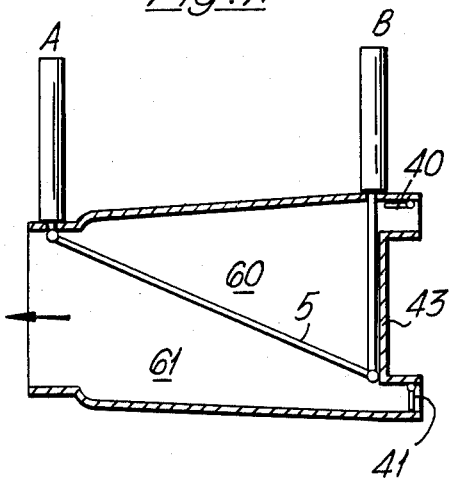
FIGS. 7 to 10 are views of construction as in FIGS. 3 to 6 with material flow being in the reverse direction.
Figure 8:
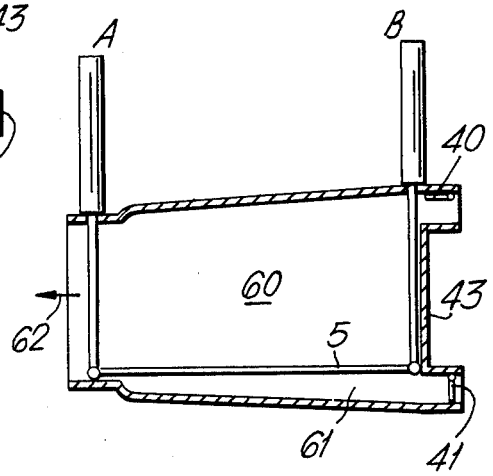

Referring to FIGS. 7 to 10, the flaps 40 and 41 open in the opposite direction and therefore movement from the position of FIG. 7 to the position of FIG. 8 will reduce the volume of space 60 expelling material in the direction of arrow 62. Flap 40 will open admitting fluid to the space 60.

Figure 9:
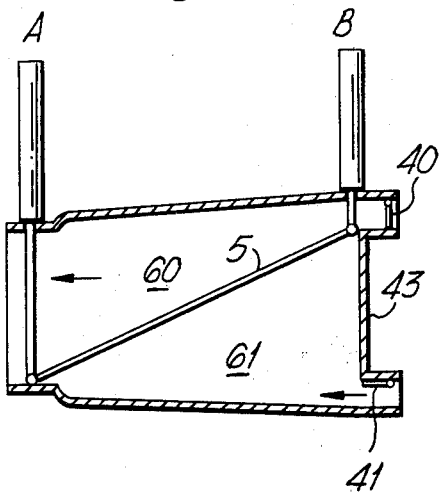

The movement to the position shown in FIG. 9 will expel fluid from space 60 allowing valve 41 to open to admit fluid to space 61.

Figure 10:
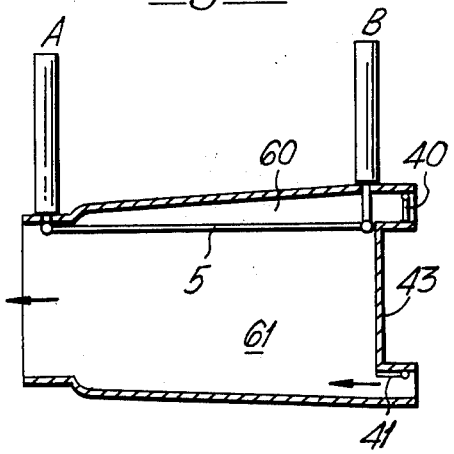

Further movements to the position of FIG. 10 further expel fluid from the space 60 and further fluid will enter the space 61.

Where gaps 32 and 33 are provided, the blade 5 seals against the partition member 43, and this may be achieved in substantially the same manner as shown in either FIG. 13 or FIG. 14. Sealing is in general required over the full stroke of that end of blade 5.

Where an enlarged bore is to be used, it is clear that the convex surfaces suggested for use with a flexible blade, cannot be employed as the blade 5 is arranged not to bear on the walls 1 and 2.

The constructions of FIGS. 2 and 3 to 10 showing double inlets or outlets such as 54 and 55 (FIG. 2) can of course be brought to a single opening substantially as shown in FIG. 1 as required.

Referring to FIG. 2, the valving arrangement by flaps 50 and 51 are such that movement of the piston 8 will cause the piston or parts associated therewith or parts associated with the blade 5 to trap one flap or other between the point of connection of the blade 5 and the piston 8 and the appropriate abutment 52 or 53, thus allowing fluid to be admitted to either the space 60 or the space 61 as appropriate and substantially preventing reverse fluid flow.

The angle (X) through which the blade may be moved may vary from about 5° to about 50° in the preferred embodiment. The optimum angle is from about 12° to about 17°.

For low volume low head application the flap valve described herein would in general not be required but where a higher efficiency or higher head operation is required the valving will aid the achievement of in particular the high head.

The piston and cylinder assemblies 6 and 7 may be hydraulic, pneumatic or steam piston and cylinder assemblies or could comprise internal combustion systems or mechanical arrangements in which translational movement is given by rotation of a shaft, using for example a connecting rod and crank or a scotch mechanism or any other mechanism for converting rotary to translational movement.

The valving arrangement shown in FIG. 2 comprising flap valve 50 and 51 may be replaced by a three piece valve having a centre abutment with flap 50 and 51 mounted at the upper and lower ends thereof.

Thus is can be seen that a method of displacing of fluid and/or apparatus for displacing fluids are provided which at least in the preferred form of the invention have some advantages. The apparatus is simple to construct and therefore is capable of being built in a robust manner to withstand lengthy service. If a fluid is being transmitted which contains solid material then a blockage in the apparatus may have the effect only of reducing efficiency temporarily until the plate is lifted off the solid object which prevents the plate reaching the end of its stroke. The efficiency of the apparatus in the propulsion of a vessel will be increased by the fact that the movement of the vessel will increase the water into the housing giving a similar effect as the admission of air into a jet engine to give good efficiency at all speeds of the vessel through the water in either direction. The pump herein described, it is envisaged, will be mounted within the vessel, there being suitable conduits between the external surface of the vessel and the pump so that fluid may be moved from the external surface through the pump and discharged to give the forward movement.

Where solids are to be pumped, the enlargement of the bore to form spaces 32 and 33 has the advantage that damage by the blade 5 to particles of for example, solids or semisolids is substantially reduced and in particular crushing of solids is substantially prevented. Damage to the blade 5 is also substantially prevented.

The recesses should be of a size which is able to accommodate at least the general maximum particle size that will be passed through the pump so that solids such as coal receive a minimum of crushing in use.

The frequency of strokes can vary from slow rates such as 1 per minute to high rates such as 3 or 4 per second, however, each stroke delivers the same torque, depending on pressure used, whatever the cycle rate.

What is claimed is:

1. A fluid displacing apparatus comprising:

a housing having an inlet end and an outlet end, the outlet end positioned in spaced relation and substantially opposite to the inlet end, each of the inlet and outlet ends having at least one opening therein, said housing further including a first wall and a second wall, the second wall positioned in spaced relation and opposite to the first wall, a plate movable within said housing, between the first wall and the second wall;

a first means for moving said plate between the first and second walls, said first moving means pivotally attached to a first end of said plate in the vicinity of the inlet end of said housing;

a second means for moving said plate between the first and second walls, said second moving means pivotally attached to the second end of said plate in the vicinity of the outlet end of said housing;

a means for controlling the timing of said first and second moving means to produce alternate and sequential movement in which said plate oscillates about a shifting center; and flow dividing means provided in the vicinity of at least one of the inlet and outlet ends of said housing so that said fluid flow is divided into at least two streams, fluid being displaced from said housing along one stream when said plate moves in one direction and through the other stream when said plate moves in the other direction.

2. An apparatus as claimed in claim 1, wherein an end wall is provided at the inlet end of said housing.

3. An apparatus as claimed in claim 1, wherein an end wall is provided at the outlet end of said housing.

4. An apparatus as claimed in claim 1, wherein means are provided at the attached ends of said plate to sealingly associate said plate with the first and second walls of said housing when the attached ends contact either the first or second walls of said housing.

5. An apparatus as claimed in claim 1, wherein said moving means comprise a fluid actuated piston and cylinder mechanism.

6. An apparatus as claimed in claim 1, wherein said moving means comprise an internal combustion mechanism.

7. Apparatus for displacing fluids as claimed in claim 1 wherein said plate comprises a flexible plate.

8. Apparatus for displacing fluids as claimed in claim 1 wherein said plate comprises an elastic plate.

9. An apparatus as claimed in claim 1, wherein said moving means comprise a mechanically actuated reciprocating means.

10. An apparatus as claimed in claim 1, wherein the first and second walls are shaped to provide a gap between each of the walls and said plate when said plate attains a position of closest approach to either the first wall or the second wall.

11. Apparatus for displacing fluids as claimed in claim 10 wherein said gap is formed by an enlarged cross-sectional area of said housing extending over a substantial length of said plate.

12. An apparatus as claimed in either claim 2 or 3, wherein means are provided at an attached end of said plate to sealingly associate said plate with said end wall when said attached end contacts said end wall.

13. Apparatus for displacing fluids as claimed in claim 1 wherein said flow dividing means comprises at least one valve, said at least one valve substantially closing the pathway of one stream when fluid is being admitted or displaced by virtue of the other stream.

14. Apparatus for displacing fluids as claimed in claim 13 wherein said at least one valve is positioned at the outlet end of said housing.

15. Apparatus for displacing fluids as claimed in claim 1, wherein said timing means causes each end of said plate to pause after movement of that end while movement of the other end of the plate occurs.

16. An apparatus as claimed in claim 13, wherein said at least one valve is positioned at the inlet end of said housing.

17. An apparatus as claimed in claim 2 or 3, wherein pivotal coupling means are provided to pivotally attach said first moving means to said first end of said plate and said second moving means to said second end of said plate, said pivotal coupling means being sealingly associated with said end wall when said pivotal coupling means contacts said end wall.

18. A method of displacing fluid, said method comprising the steps of imparting rectilinear motion to a plate having a first end and a second end positioned in a housing which housing includes a first wall and an opposite second wall and an end wall having at least one aperture in it, said housing having at least one opening opposite said end wall, said motion being effected by at least two moving means, said moving means being a first moving means and a second moving means disposed one at each end of said plate, said method effecting a cycle of movement by including the steps of: sealing said first end of said plate against said first wall of said housing and sealing said second end of said plate against said opposite second wall; actuating said first moving means to move said first end of said plate adjacent said at least one opening from the sealing position against said first wall of said housing to a position against said opposite second wall of said housing while said second end of said plate is held in sealing relationship with said opposite second wall by said second moving means; sealing said first end of said plate against said opposite second wall; actuating said second moving means to move said second end of said plate across said end wall from said sealing relationship with said second wall to a position against said first wall while said first end is held in sealing relationship with said second wall; sealing said second end of said plate against said first wall; actuating said first moving means to move said first end of said plate from said sealing relationship with said second wall to a position against said first wall while said second end of said plate is held in a sealing relationship with said first wall; sealing said first end of said plate against said first wall; and actuating said second moving means to move said second end of said plate from sealing relationship with said first wall to a position against said second wall; sealing said second end of said plate against said second wall while said first end is held by said first moving means in sealing relationship with said first wall, said cycle being effected in forward or reverse order so that fluid is displaced from said housing in a desired direction, each movement of said plate being such that fluid is displaced from said housing in a desired direction.

19. A method as claimed in claim 18, wherein said moving means comprise a fluid actuated piston and cylinder mechanism.

20. A method as claimed in claim 18, wherein said moving means comprise a mechanically actuated reciprocating means.

21. A method of displacing fluid as claimed in either claim 18 wherein said housing includes at least one valve to substantially allow fluid flow in the desired direction but to substantially prevent fluid flow in direction other than the desired direction.

* * * * *